United States Patent [19]

Wells

[11] 4,014,720

[45] Mar. 29, 1977

[54] FLEXIBLE EXPLOSIVE COMPOSITION COMPRISING PARTICULATE RDX, HMX, OR PETN AND A HIGH VISCOSITY INTROCELLULOSE BINDER PLASTICIZED WITH TEGDN

[75] Inventor: Franklin B. Wells, Memphis, Tenn.

[73] Assignee: The United States of America as represented by the Secretary of the Army, Washington, D.C.

[22] Filed: Oct. 28, 1975

[21] Appl. No.: 625,978

[52] U.S. Cl. ..... 149/19.8; 149/92; 149/93; 149/96

[51] Int. Cl.[2] ..... C06B 45/10

[58] Field of Search ..... 149/19.8, 92, 93, 96

[56] References Cited

UNITED STATES PATENTS

| | | | |
|---|---|---|---|
| 3,317,361 | 5/1967 | Hopper et al. | 149/19.8 |
| 3,400,025 | 9/1968 | Hopper et al. | 149/19.8 |
| 3,489,623 | 1/1970 | Griffith et al. | 149/96 X |
| 3,689,331 | 9/1972 | Pierce | 149/19.8 X |
| 3,715,248 | 2/1973 | Swotinsky et al. | 149/19.8 X |
| 3,862,864 | 1/1975 | Flyan et al. | 149/19.8 |
| 3,878,003 | 4/1975 | LoPresti et al. | 149/92 X |

*Primary Examiner*—Edward A. Miller
*Attorney, Agent, or Firm*—Nathan Edelberg; A. Victor Erkkila

[57] ABSTRACT

Flexible, self-supporting explosive compositions composed essentially entirely of a particulate high explosive RDX, HMX and/or PETN and a high viscosity nitrocellulose binder plasticized with triethyleneglycol dinitrate.

3 Claims, No Drawings

FLEXIBLE EXPLOSIVE COMPOSITION COMPRISING PARTICULATE RDX, HMX, OR PETN AND A HIGH VISCOSITY INTROCELLULOSE BINDER PLASTICIZED WITH TEGDN

GOVERNMENTAL INTEREST

The invention described herein may be manufactured, used and licensed by or for the Government for governmental purposes without the payment to me of any royalties thereon.

BACKGROUND OF THE INVENTION

It is known to prepare flexible explosive compositions of high power by mixing a high explosive, such as RDX, and a high viscosity nitrocellulose containing a nonenergetic organic plasticizer, e.g. tributyl acetylcitrate, alone or in mixture with an energetic plasticizer of the organic polyol nitrate ester type, e.g. trimethylolethane trinitrate (TMETN) (U.S. Pat. Nos. 3,317,361, 3,354,010 and 3,400,025). It is also known to prepare flexible explosive compositions from a high explosive such as RDX and a high viscosity nitrocellulose by employing TMETN in the absence of a non-energetic plasticizer, as disclosed in my copending U.S. application Ser. No. 454,900, filed Mar. 26, 1974, and now U.S. Pat. No. 3,943,017. Such compositions represent valuable improvements in the art, but they are still deficient in one or more significant properties, notably explosive power, flexibility at low temperatures, e.g. −40° F., ease of manufacture, etc.

SUMMARY OF THE INVENTION

An object of the present invention is to provide a flexible, self-supporting explosive composition of high power (at least 125% of the explosive power of TNT) and high brisance (rate of detonation at least 7500 meters per second), which is composed essentially entirely of explosively active ingredients including a finely divided explosive such as cyclotrimethylenetrinitramine (RDX), cyclotetramethylenetetranitramine (HMX), and pentaerythritol tetranitrate (PETN), and mixtures thereof, bonded with a high viscosity nitrocelulose plasticized with triethyleneglycol dinitrate (TEGDN).

Another object of the invention is to provide an explosive composition which, in the form of sheets of at least one-quarter inch thickness, possesses sufficient flexibility so that it may be made to conform to the contours of uneven surfaces with a minimum of manipulation, thus aiding in the complete destruction of the device to be demolished.

A further object of the invention is to provide a flexible explosive composition having high resistance to impact and friction while retaining good cap-sensitivity.

A still further object of the invention is to provide a flexible explosive composition which retains flexibility at temperatures of −40° C. or lower.

Other objects of this invention will become apparent as the invention is further described hereinafter.

In accordance with the present invention the foregoing objects are attained by novel explosive compositions, which are composed essentially entirely of explosive ingredients and consist essentially of a. about from 50 to 90 weight percent of a particulate high explosive selected from the group consisting of RDX, HMX and PETN and mixtures thereof, and b. about from 10 to 50 weight percent of a binder system consisting essentially of a high viscosity nitrocellulose containing about from 12.1 to 12.5 percent nitrogen and TEGDN plasticizer therefor, wherein the amount of said nitrocellulose is about from 1 to 8, and preferably about from 4 to 6 weight percent of the composition and the weight ratio of said plasticizer to said nitrocellulose is about from 4:1 to 7:1, respectively.

Preferred explosive compositions, which can be rolled into sheets of good flexibility, are obtained when the content of particulate high explosive in the novel compositions is about from 50 to 70 weight percent. When the content of particulate high explosive in the novel compositions exceeds about 70 weight percent, the compositions are not sufficiently plastic to permit rolling into sheets suitable for use as a flexible sheet explosive, but they can be compression molded and machined and still possess sufficient flexibility or resilience so that the formed charges can be loaded to conform to slight contour irregularities of the item casing. When the content of the particulate high explosive exceeds about 90 weight percent, the composition is ordinarily too stiff to prepare compression molding having any detectable degree of flexibility; and when the content thereof is less than about 50 weight percent, the composition is too soft and sticky, and does not possess sufficient body required to obtain smooth sheets by rolling procedures.

The ratio of the TEGDN plasticizer to the high viscosity nitrocellulose in the binder system of the explosive compositions of this invention is important and should be in the range of about from 4:1 to 7:1, respectively, ratios of about from 5:1 to 6:1 being preferred, particularly in conjunction with a content of high viscosity nitrocellulose in the composition of about from 4 to 6 weight percent. It has been found that binder systems having a TEGDN/ nitrocellulose ratio of about 3:1 or lower are usually not sufficiently fluid to provide a satisfactory binding action, while those wherein this ratio is about 8:1 or higher ordinarily provide a gel which is too soft and weak for practical use as a binder system in the present compositions.

The novel explosive compositions of the invention may also contain small amounts up to 2–5 weight percent, of conventional additives, such as stabilizers and pigments.

The high explosives employed in the compositions of the present invention possess an average particle size not exceeding about 25 microns, although both larger and smaller particles thereof may be present. Preferably 100% of the particulate explosive must pass through a No. 200 USS sieve and at least 90%, and preferably not less than 95%, should pass through a No. 325 USS sieve. Use of any appreciable amounts of coarser grades of particulate explosive tends to result in increased flexibility with accompanying reduction in strength of the product and a product in which the grains of particulate explosive are readily visible by reflected light.

The high viscosity nitrocellulose employed in the binder system of the compositions of this invention contains about 12.1 to 12.5% nitrogen and possesses such a degree of polymerization as to have a viscosity, using a 4% solution and a 5/16 inch diameter steel ball, as described below, of at least 90 seconds.

In the determination of the nitrocellulose viscosity, the 5/16 inch diameter steel ball weighs 2.025–2.045 grams, the viscosimeter consists of a vertically mounted glass tube 14 inches long with an internal diameter of one inch immersed to the level of its liquid contents in a constant temperature bath maintained at 25° C. ± 0.2° C., and the time of passage of the ball between markings is noted as the viscosity (in seconds).

The aforementioned viscosity test is run in accordance with paragraphs 4.4.5 et seq. of specification MIL-N-244A dated Feb. 15, 1962, with the exception that the quantities used shall be: 8 grams nitrocellulose, 21.3 grams ethanol, and 170.7 grams acetone. The 21.3/170.7 alcohol/acetone ratio is used to maintain an essentially 1/8 ratio as is required in the specification.

Many liquid nitric acid esters have been employed as plasticizers for nitrocellulose but they all have one or more undesirable characteristics. For example, glycol dinitrate, glycerol trinitrate, 1,2,4-butanetriol trinitrate (BTTN) and diethyleneglycol dinitrate (DEGDN) are all considered to be too sensitive to friction and impact to be completely suitable for use in the compositions of this invention. 1,2,6-Hexanetiol trinitrate has low energy and trimethylolethane trinitrate (TMETN) colloids nitrocellulose with difficulty. Therefore, it was surprising to find that TEGDN can be employed to colloid high viscosity nitrocellulose to provide the flexible explosive compositions of the present invention, which fullfil all of the objectives noted previously.

Experience has shown that compositions of the type described herein lose their flexibility at temperatures at about or slightly above the melting point of the liquid nitric ester plasticizer employed. Indeed, as shown in tests described in examples 1 and 3 below, it was found that compositions containing DEGDN (m.p. +2° C.) or TMETN (m.p. about −3° C.) lost their plasticity at 10° C. or slightly below. It was therefore unexpected to discover that the explosive compositions of this invention, which are composed essentially 100% of energetic components and wherein the binder system consists of high viscosity nitrocellulose plasticized with TEGDN (m.p. variously reported at −17° to −23° C.), retain their plasticity at temperatures at or below −40° C.

It is also known that TEGDN is not a very energetic explosive material. It has such poor explosive characteristics that detonation will not propagate through a 1¼ inch diameter column thereof even under the confinement afforded by heavy steel tubing. Therefore, as a plasticizer it approaches to some extent the diluent effect of such inactive esters as the tributyl acetylcitrate plasticizer employed in the flexible explosive composition EL 506C marketed by E. I. DuPont de Nemours & Co. as well as in the binder systems employed in the explosive compositions of U.S. Pats. Nos. 3,317,361, 3,354,010 and 3,400,025. Thus, it would be expected in view of its low energy that com-positions containing appreciable amounts of TEGDN would suffer to some extent with respect to explosive power and brisance.

Accordingly, it was unexpected to find that TEGDN imparts relatively little diluent effect and consequent loss of explosive characteristics in the compositions of this invention. Thus, for example, as shown in example 4 described below, a composition of this invention, which contains a considerable amount, 30% by weight, of TEDGN, still exhibits 128% of the power of TNT and high brisance, as indicated by a high detonation rate of over 7700 meters per second, even at a density of only 95% of the theoretical maximum density (TMD).

As in the flexible sheet explosives disclosed in U.S. Pat. Nos. 3,317,361, 3,354,010 and 3,400,025, low viscosity nitrocellulose is not a satisfactory replacement for the high viscosity nitrocellulose employed in the binder system of the compositions of the present invention. Thus, for example, it was found that low viscosity nitrocelluloses containing 12–13% nitrogen and ranging in viscosity from about ½ second to 18 seconds were not suitable for use as binders in place of the high viscosity nitrocellulose employed in the explosive compositions of this invention. As increasing proportions of high viscosity nitrocellulose in the binder system were replaced with low viscosity nitrocellulose, the strength of the resulting flexible explosive composition decreased markedly until at complete substitution of high viscosity nitrocellulose with low viscosity nitrocellulose, the product became too weak to serve as a useful sheet explosive.

The following examples provide further specific illustrations of the explosive compositions of this invention. In the examples the proportions reported are by weight.

EXAMPLE I

Four compositions were prepared to determine the comparative effect upon the finished product of the use of the plasticizers TEGDN, TMETN, DEGDN, and BTTN. While DEGDN and BTTN, as noted earlier, are considered to be too sensitive to serve as satisfactory plasticizers for the flexible sheet explosives of this invention, particularly since such sheet explosives may often be carried in the field by individual personnel, and while neither TMETN, DEGDN, nor BTTN are to be considered for use in the compositions of this invention, a comparative examination of the effect of their presence in the same type of compositions is of interest and of value in illustrating the advantages to be gained through use of TEGDN as plasticizer therein. The compositions are shown in Table I.

Table I

| Composition No. | 1 | 2 | 3 | 4 |
|---|---|---|---|---|
| RDX, Class E[1] | 50.0% | 50.0% | 50.0% | — |
| HMX, Class B[2] | — | — | — | 56.0% |
| Nitrocellulose (96 second)[3] | 8.0 | 8.0 | 8.0 | 4.0 |
| TEGDN | 40.8 | — | — | — |
| DEGDN | — | 40.8 | — | — |
| BTTN | — | — | 40.8 | — |
| TMETN | — | — | — | 40.0 |
| DPA | 0.4 | 0.4 | 0.4 | 0.2[4] |

Table I-continued

| Composition No. | 1 | 2 | 3 | 4 |
|---|---|---|---|---|
| Pigment | 0.8 | 0.8 | 0.8 | — |

[1]All RDX used in the preparation of the compositions of this invention is in accordance with the requirements of specification MIL-R-398C dated August 22, 1962, and is in an essentially anhydrous state unless otherwise noted.
[2]All HMX used in the preparation of the compositions of this invention is in accordance with the requirements of specification MIL-H-45444 (Ord) with amendment 3 dated July 30, 1962, and is in an essentially anhydrous state unless otherwise noted.
[3]All nitrocellulose used in the preparation of the compositions of the examples is 96 second dynamite grade material and is in an essentially anhydrous state unless otherwise noted.
[4]In Composition 4, the DPA content is given as added (above 100) percent.

The solid ingredients were first thoroughly mixed, ethyl acetate in an amount of up to about 50 milliliters per 100 grams of solid ingredients stirred in, and the mixtures covered and allowed to age about 24 hours. The liquid plasticizers were then stirred in and the resulting mixtures were covered and set aside to age for at least 16 hours. Each mixture was then processed on a small laboratory roll mill held at not less than about 135° F. in most cases. Rolling was first carried out using a roll gap of 0.002 inch for at least 2 minutes after all odor of solvent had disappeared from the material on the rolls. The material was then removed from the rolls as a thin sheet, the gap setting increased to 0.230–0.240 inch, and the thin sheet material consolidated into sheets about one-quarter inch in thickness at a roll temperature of 0°–15° F. below that used to drive off solvent and assure uniformity of composition. (In subsequent preparational work it was found that most of the aging used in this and the following example (EXAMPLE 2) could be omitted).

The roll milling process described produced smooth, flexible sheets, olivedrab in color, of which Compositions 1, 2, and 3 were rather soft.

Compositions 1, 2 and 4 were subjected to the cold temperature test[1] with the results shown in Table 2.

Table 2

| Composition No. | 1 | 2 | 4 |
|---|---|---|---|
| Cold temperature (° C.) | −45° | 0° | +10° |

[1] The cold temperature test is described in paragraph 4.3.12 of MIL-3-46676A (MU) dated 17 April 1964. In this work the variation was introduced that the test was run at various temperatures 5° C. apart. The test result is then reported as that test temperature at which, in three trials, the 1/4 inch by 3/8 inch by 3 inch long specimens neither break nor develop cracks deeper than 1/16 inch in the face away from the mandrel when bent 90° in five seconds as required by the test.

The result obtained with Composition 1, wherein the plasticizer used was TEGDN, was entirely unexpected, especially in view of the result obtained with Composition 2 wherein the plasticizer used was DEGDN (m.p. +2° C.) which is similar in many ways to TEGDN (m.p. about −20° C.). Results shown for Compositions 2 and 4, wherein DEGDN and TMETN, respectively, were used as plasticizers, also conform to previous findings that, in general, flexible explosive compositions bonded with nitrocellulose plasticized with liquid nitric esters lose plasticity at a temperature not very different from that of the melting point of the nitric ester plasticizer used.

When finely divided PETN (average particle size 10 microns) was employed in place of RDX in the preparation and processing of Composition 1 as described above, a flexible sheet explosive was obtained which possessed similar physical properties to the sheet explosive from Composition 1.

EXAMPLE 2

Nine compositions shown in Table 3 were prepared in the same way as were compositions 1–4 to determine the effect of the use of mixed liquid nitric acid esters as plasticizers in flexible sheet explosives bonded with high viscosity nitrocellulose.

Table 3

| Composition No. | 5 | 6 | 7 | 8 | 9 | 10 | 11 | 12 | 13 |
|---|---|---|---|---|---|---|---|---|---|
| RDX, Class E | 50.0% | 50.00% | 50.0% | 50.0% | 50.00% | 50.0% | 50.0% | 50.00% | 50.0% |
| Nitrocellulose (96 sec.) | 8.0 | 6.00 | 4.0 | 8.0 | 6.00 | 4.0 | 8.0 | 6.00 | 4.0 |
| TEGDN | 38.8 | 21.44 | 4.0 | — | — | — | — | — | — |
| DEGDN | — | — | — | 37.6 | 21.44 | 2.0 | — | — | — |
| TMETN | 2.0 | 21.46 | 41.8 | 4.0 | 21.46 | 43.8 | 4.0 | 21.44 | 41.8 |
| DPA | 0.4 | 0.30 | 0.2 | 0.4 | 0.30 | 0.2 | 0.4 | 0.30 | 0.2 |
| Pigment | 0.8 | 0.80 | — | — | 0.80 | — | — | 0.80 | — |
| BTTN | — | — | — | — | — | — | 37.6 | 21.46 | 4.0 |

The compositions of this example were prepared and formed into sheets in a manner essentially identical with that used for the preparation of sheets of the compositions of example I. With the exception of an olivedrab color in cases where pigment was included in the formulation, similar smooth flexible sheets were obtained in all instances. The sheets of Compositions 5, 8 and 11 were rather soft and easily deformed as was the sheet of Composition 1. Sheets of Compositions 6, 9 and 12 were a little firmer. Sheets of Compositions 7, 10 and 13 were much firmer, stronger, and more elastic than the others but not quite so much so as was the sheet of Composition 4.

Compositions 5, 6 and 7 illustrate the difference between TEGDN and TMETN used as a plasticizer with a constant amount of particulate explosive (RDX). These compositions show that a minor amount of either plasticizer in the presence of a major amount of the other, has little effect on the consistency of the product; but that as the ratio of TEGDN to TMETN is decreased — even though the nitrocellulose quantity is reduced by 50%, whereby the plasticizer/ nitrocellulose ratio is increased from 5/1 to 10.5/1 — the product becomes much stiffer. Compositions 8–13 illustrate the same effect with DEGDN/TMETN and BTTN/TMETN plasticizer mixture. Because of their relatively high sensitivity to shock and friction, the use of energetic plasticizers such as BTTN and DEGDN is not contemplated in the present invention.

Example 3

| Composition No. 14 | |
|---|---|
| HMX, Class B | 320.0 g. (64.0%) |
| Nitrocellulose (96 second) | 30.0 g. (6.0%) |
| TEGDN | 150.0 g. (30.0%) |
| DPA (added %) | 1.5 g. (0.3%) |
| Theoretical Maximum Density (TMD) = 1.6685 g./cc. | |

The solid ingredients were mixed together, the TEGDN and 100 ml. of ethyl acetate stirred in, and the whole mixed 30 minutes at 50°–60° C. in a sigma blade mixer. After aging overnight this mixture was formed into ¼ inch thick sheets by the method outlined in example I to give a good, smooth, firm, flexible sheet. This material was partially characterized by the following test results.

| | |
|---|---|
| 20/d4 | 1.6573 g./cc. |
| Percent TMD | 99.33 |
| Friction Pendulum Test (steel shoe)[2] | No crackles, flame, or explosion |
| P.A. Impact Sensitivity Test[3] | 13 inches |
| Vacuum Stability Test (5 g./100° C./40 hrs.) | 1.49 ml. gas evolved |
| Vacuum Stability Test (5 g./110° C./40 hrs.) | 5.49 ml. gas evolved |
| Cold Temperature Test | −50° C. |

[1]The symbol 20/d4 indicated the ratio of the density of the explosive sheet at 20° C. to the weight of an equal volume of water at 4° C.
[2]The Friction Pendulum Test (steel shoe) is described by J. H. MacIvor in Picatinny Arsenal Testing Manual 7-1 dated May 8, 1950
[3]The Picatinny Arsenal Impact Sensitivity Test is described in PATR 3278, Rev. 1 by A. J. Clear dated April, 1970

Example 4

| Composition No. 15 | |
|---|---|
| HMX, Class B (dry basis) | 7264.0 g. (64.0%) |
| Nitrocellulose 96 second (dry basis) | 681.0 g. (6.0%) |
| TEGDN | 3405.0 g. (30.0%) |
| DPA (added %) | 34.1 g. (0.3%) |

This 25 pound batch of Composition 15 was identical, compositionwise, with Composition 14, but because of the scale of operations it was necessary to use alcohol-moist HMX and nitrocellulose in its preparation. The alcohol-moist HMX and nitrocellulose were mixed in a 5 gallon sigma blade mixer for about 5 minutes. One half of the TEGDN was then added and stirred in for about two minutes after which the remaining TEGDN and 200 milliliters of ethyl acetate containing the DPA in solution were added and stirring again carried on for about 2 minutes. The TEGDN container was then rinsed with two consecutive 400 milliliter portions of ethyl acetate, the rinsings added to the material in the mixer, and the whole stirred 10 minutes and then let stand overnight. The mix was then stirred at 140° F. for about an hour, removed from the mixer, and held in a sealed container until it could be formed into sheets by rolling on a large rolling mill.

The material was first rolled at a gap setting of 0.002 inch and at a temperature of 150°–155° F. for two minutes after all odor of solvent had disappeared. The thin sheets of material thus obtained were then consolidated into thicker sheets. Some material was rolled at a gap setting of about 0.07 inch to obtain a sheet 0.08 inch thick and some at a gap setting of about 0.145 inch to obtain a sheet 0.160 inch thick, sheets of these thicknesses, as well as of 0.250 inch being required for use in the Plate Damage Test referred to below. Most of the remainder of the material was rolled at a gap setting of 0.230 inch to produce sheets 0.250 inch thick. All sheets were smooth and somewhat rubbery. The material was partially characterized by the following test results.

| | |
|---|---|
| 20/d4 | 1.5882 g./cc. |
| % TMD | 95.19% |
| Ballistic Pendulum Test (TNT = I) | 1.279 |
| Rate of detonation[1] | 7741 m./sec. |
| Bullet Impact Test[2] | No fire or explosion |
| Cap Sensitivity Test[3] | No. 8 cap |
| Plate Damage Test[4] | Excellent cutting power |

[1]The specimens used were 1 inch by 1 inch by 15 inches long and unconfined.
[2]The bullet Impact Test is described in paragraph 4.3.7 of specification MIL-E-46676A (MU) dated 17 April 1964. In this test ten rounds of 30 caliber M2 ball cartridge are fired from a 30 caliber M1 rifle perpendicular to the target at 40 feet. The target consists of a ¼ inch by 3 inch by 3 inch sheet of flexible explosive sandwiched between a 1/16 inch thick mild steel front plate and a 1 inch thick mild steel back-up plate.
[3]A ¼ inch wide by ¾ inch deep slot is cut into one end of a ¼ inch thick by 1 inch wide by 12 inch long test specimen, a standard blasting cap crimped onto miners' fuze inserted into the slot and taped in place, and the cap fired. The result is given as the smallest (lowest number) standard cap which will cause complete detonation of a test specimen in each of five consecutive trials.
[4]The Plate Damage Test is carried out by centering a 3 inch by 10 inch sheet of explosive on a ¼ inch by 4 inch by 12 inch mild steel witness plate set on a smooth damp sand surface. A ½ inch thick plate may be used if the explosive is so energetic as to essentially demolish the ¼ inch thick plate. The sheet is fired using an M6 cap set into a θ inch wide by ¾ inch deep slot cut into the center of one end thereof. In the case of 0.08 inch thick sheets, a small piece of the 0.08 inch thick material is laid across the top of the initiating cap so that both ends of this small piece are in contact with the sheet. In this test all sheets fired completely and examination of the steel witness plates showed this composition to be at least 50% more effective in cutting steel than the proprietary commercial flexible sheet explosive, duPont's EL 506C, currently in military use or a nonproprietary sheet explosive developed as a replacement therefor and which is described in U.S. 3,317,361 and 3,354,010. It was also noticeably more effective than the flexible sheet material of U.S. 3,400,025 and the British-made sheet explosive SX-2.

EXAMPLE 5

The composition of this example was prepared by the precipitation method d described below. The water used was saturated with TEGDN (27 grams/5000 ml. of water), usually by addition of this extra amount to the lacquer used in the said precipitation method of preparation.

| Composition No. 16 | |
|---|---|
| HMX, Class B | 210.0 g. (70.0%) |
| Nitrocellulose (96 second) | 15.0 g. (5.0%) |
| TEGDN | 75.0 g. (25.0%) |
| DPA (added %) | 0.9 g. (0.3%) |

The 15 grams of nitrocellulose, 0.9 grams of DPA, and 102 grams (75 plus 27 for saturation of the water) of TEGDN were made up into a lacquer with about 1600 grams of ethyl acetate using a Cowles Dissolver.

This lacquer was then added in a thin stream to a vigorously agitated suspension of the HMX in 5000 milliliters of water held at about 65° C. When addition of the lacquer was complete, after about 90 minutes, the temperature of the suspension was raised to 85° C. to drive off all races of solvent and then cooled to 35° C. Sufficient fresh water was added to the suspension to bring the liquid level up to the point where it had been when the said suspension was first made, vigorous agitation continued for about 30 minutes, the whole filtered, and the solid matter thus obtained dried; 287 grams of product were obtained in the form of discrete granules of about 1/16 to ⅛ inch in maximum dimension, which showed little tendency to stick together. This material was partially characterized by the following test results:

| | |
|---|---|
| Picatinny Arsenal Impact Sensitivity Test | 12 inches |
| Vacuum Stability Test (5 g./100° C./40 hrs.) | 1.90 ml. gas evolved |

A ¾ inch diameter by 1.985 inch long pellet of this material was formed by pressing at 165° F. and 8000 psi. Density of this pellet, pressed as a single increment, was found to be 1.667 g./cc., corresponding with 97.9% of the TMD of 1.7026 g./cc. In practice, to conserve materials and prevent pollution, the filtrate can be re-used as the suspending medium in following batches. This eliminates the need for addition of the TEGDN required for saturation of fresh water. Batches prepared with the use of filtrate from the preceeding batch as suspending liquid appeared to be identical in all respect with those prepared when fresh water was used as suspending medium.

Three additional batches of this composition were prepared in a manner as nearly identical as possible with that used for the first batch thereof. The yields were 290, 294 and 291 grams, respectively. These three batches and the remainder of the first batch left after material had been removed for the above-noted tests were mixed and a portion of this blended material was pressed at 8000 psi to form a pellet about 2½ inches in diameter. Details of pressing are:

| | |
|---|---|
| Pressing temperature (° F.) | 140° |
| Pellet weight (grams) | 284.4 |
| Pellet density (g./cc.) | 1.697 |
| Pellet density as percent TMD | 99.67 |

EXAMPLE 6

The composition of this example was prepared with the following materials by the precipitation method as described in example 5.

| Composition No. 16 | |
|---|---|
| Nitrocellulose (96 second) | 16.0 g. (4.0%) |
| TEGDN | 80.0 g. (20.0%) |
| DPA | 0.8 g. (0.2%) |
| Ethyl acetate | 1280 ml. |
| HMX | 304.0 g. (76.0%) |
| TEGDN (to saturate the water) | 30.0 g. |

-continued

| Composition No. 16 | |
|---|---|
| Distilled water | 5500 ml. |

The lacquer prepared from the nitrocellulose, TEGDN, DPA and ethyl acetate was added to the HMX suspension in the TEGDN-saturated water, and the resulting mixture was processed in the aforesaid manner.

The composition thus obtained was so stiff that it could not be formed into a sheet by rolling. Several batches of this composition were prepared. Some of these batches were mixed together and a portion of the mixture was molded under a pressure of 8000 psi and at a temperature of 145° F. into a pellet about 2.5 inches in diameter. The pellet thus obtained possessed good mechanical strength and had a density of 1.723, corresponding with 99.08% of the TMD of 1.739 g./cc.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

I claim:

1. A flexible, self-supporting explosive composition of high power and brisance composed essentially entirely of explosive ingredients and consisting essentially of a. about from 50 to 90 weight percent of a particulate high explosive selected from the group consisting of cyclotrimethylenetrinitramine, cyclotetramethylenetetranitramine and pentaerythritol tetranitrate and mixtures thereof having an average particle size not exceeding about 25 microns; and b. about from 10 to 50 weight percent of a binder system consisting essentially of high viscosity nitrocellulose containing about from 12.1 to 12.5 percent nitrogen, and triethyleneglycol dinitrate plasticizer;

wherein the amount of said nitrocellulose is about from 1 to 8 weight percent of the composition and the weight ratio of said plasticizer to said nitrocellulose is about from 4:1 to 7:1, respectively.

2. A flexible, self-supporting explosive composition of high power and brisance adapted for use as a flexible sheet explosive, composed essentially entirely of explosive ingredients and consisting essentially of:

a. about from 50 to 70 weight percent of a particulate high explosive selected from the group consisting of cyclotrimethylenetrinitramine, cyclotetramethylenetetranitramine and pentaerythritol tetranitrate and mixtures thereof having an average particle size not exceeding about 25 microns; and b. about from 30 to 50 weight percent of a binder system consisting essentially of high viscosity nitrocellulose containing about from 12.1 to 12.5 percent nitrogen, and triethyleneglycol dinitrate plasticizer;

wherein the amount of said nitrocellulose is about from 4 to 8 weight percent of the composition and the weight ratio of the plasticizer to the nitrocellulose is about from 4:1 to 7:1, respectively.

3. The composition of claim 2, wherein the weight ratio of the plasticizer to the nitrocellulose is about from 5:1 to 6:1, respectively, and the amount of the nitrocellulose is about from 4 to 6 weight percent of the composition.

* * * * *